US006334387B1

(12) United States Patent
Motoe

(10) Patent No.: US 6,334,387 B1
(45) Date of Patent: Jan. 1, 2002

(54) STENCIL PRINTER HAVING CARRIAGE FOR GUIDING LEADING END OF STENCIL SHEET

(75) Inventor: Katsuro Motoe, Inashiki-gun (JP)

(73) Assignee: Riso Kagako Corporation, Tokyo (JP)

( * ) Notice: Subject to any disclaimer, the term of this patent is extended or adjusted under 35 U.S.C. 154(b) by 0 days.

(21) Appl. No.: 09/552,754

(22) Filed: Apr. 19, 2000

(30) Foreign Application Priority Data

May 18, 1999 (JP) ..... 11-136830

(51) Int. Cl.[7] ..... B41L 13/04
(52) U.S. Cl. ..... 101/116; 101/128.4; 101/477
(58) Field of Search ..... 101/114, 116, 101/117, 118, 119, 120, 127, 127.1, 128.1, 128.21, 128.4, 129, 477, DIG. 35

(56) References Cited

U.S. PATENT DOCUMENTS 5,558,019 A * 9/1996 Kawai et al. ..... 101/128.4
5,709,151 A * 1/1998 Dürr et al. ..... 101/477

FOREIGN PATENT DOCUMENTS

JP A-6-320853 11/1994
JP A-2804695 7/1998

* cited by examiner

*Primary Examiner*—Leslie J. Grohusky
(74) *Attorney, Agent, or Firm*—Oliff & Berridge, PLC

(57) ABSTRACT

To provide a stencil printer equipped with a carriage capable of stably and definitely conducting a leading end of a stencil sheet from a position at an outlet of a stencil sheet perforation device to a stencil sheet leading end mounting device of a printing drum and also capable of braking the stencil sheet so that the stencil sheet is wound around the printing drum according to its rotation under any optimum controlled expansion applied thereto, the carriage is provided with a stencil sheet leading end clamping device and a pair of stencil sheet leading end feeding rollers, separately, the stencil sheet leading end clamping device clamping the leading end of the stencil sheet when the carriage moves from the position at the outlet of the stencil sheet perforation device to the stencil sheet leading end mounting device of the printing drum, while the stencil sheet leading end feeding roller pair feeding out the stencil sheet leading end toward the stencil sheet leading end mounting device of the printing drum after the carriage has reached the vicinity of the stencil sheet leading end mounting device of the printing drum.

6 Claims, 7 Drawing Sheets

STENCIL PRINTER HAVING CARRIAGE FOR GUIDING LEADING END OF STENCIL SHEET

BACKGROUND OF THE INVENTION

1. Field of the Invention

The present invention relates to a stencil printer, an more particularly, to an improvement of means for conducting a leading end of a stencil sheet perforated by stencil sheet perforation means to stencil leading end mounting means of a printing drum.

2. Description of the Prior Art

There has been proposed by Japanese Patent No. 2804695 a stencil printer having stencil sheet leading end holding and transporting means adapted to reciprocate between a vicinity of stencil sheet perforation means and a vicinity of stencil sheet leading end mounting means of a printing drum stopped at a stencil sheet mounting position, wherein the stencil sheet leading end holding and transporting means are operated to hold a leading end of a stencil sheet perforated by the stencil sheet perforation means at an outlet of the stencil sheet perforation means as projecting forward as much as can be clamped by stencil sheet leading end mounting means of the printing drum, and move to the vicinity of the stencil sheet leading end mounting means, and then the printing drum is rotated so as to wind up the stencil sheet therearound, with the stencil sheet leading end holding and transporting means holding the stencil sheet by a force weaker than a stencil sheet holding force of the stencil sheet leading end mounting means of the printing drum, so that thereby the stencil sheet is wound around the printing drum in an expanded condition.

When the stencil sheet leading end holding and transporting means for holding and transporting the stencil sheet leading end from the outlet of the stencil sheet perforation means to the vicinity of the stencil sheet leading end mounting means of the printing drum are adapted also to serve as the means for expanding the stencil sheet during a winding-up thereof around the printing drum as in the above-mentioned patent, it is difficult to set up the friction condition of the clamping to be suitable for definitely and stably transporting the leading end of the stencil sheet from the outlet of the stencil sheet perforation means to the vicinity of the stencil sheet leading end mounting means of the printing drum and also to be suitable for desirably expanding the stencil sheet without damaging it while it is wound around the printing drum, since these two conditions are not compatible with one another.

Further, when the leading end of the stencil sheet is transported by the stencil sheet leading end holding and transporting means from the outlet of the stencil sheet perforation means to the vicinity of the stencil sheet leading end mounting means of the printing drum as projecting forward enough to be caught by the stencil sheet leading end mounting means of the printing drum, when the speed of the transportation increases, the forward projecting leading end of the stencil sheet is bent by a wind caused by the movement thereof, so that the leading end would not be correctly caught by the stencil sheet leading end mounting means of the printing drum.

SUMMARY OF THE INVENTION

In consideration of the above-mentioned problems, it is a primary object of the present invention to provide a stencil printer equipped with a stencil sheet leading end guiding carriage improved so as not to cause those problems.

In order to solve, the above-mentioned problems, the present invention proposes a stencil printer comprising:

a printing drum having means provided along a generatrix of a cylindrical circumference thereof for mounting a leading end of a stencil sheet, the printing drum being adapted to be stopped at a predetermined rotational position for mounting the stencil sheet thereon;

means for perforating the stencil sheet; and a carriage guided to reciprocate between a vicinity of an outlet of the stencil sheet perforation means and a vicinity of the stencil sheet leading end mounting means of the printing drum stopped at the predetermined rotational position;

wherein the carriage has means for selectively clamping the leading end of the stencil sheet perforated by the stencil sheet perforation means, and a pair of rollers for feeding the stencil sheet when the stencil sheet leading end clamping means are not clamping the stencil sheet, the stencil sheet feeding roller pair being adapted to feed the stencil sheet which had been clamped at the leading end thereof by the stencil sheet leading end clamping means toward the stencil sheet leading end mounting means as starting from the leading end when the carriage is positioned in the vicinity of the stencil sheet leading end mounting means of the printing drum stopped at the predetermined rotational position and then to brake the stencil sheet while it is being wound around the circumference of the printing drum with the leading end thereof being held by the stencil sheet leading end mounting means.

By the stencil sheet leading end holding means for holding and pulling the leading end of the stencil sheet from the vicinity of the outlet of the stencil sheet perforation means to the vicinity of the stencil sheet leading end mounting means of the printing drum are constructed as means separate from the means for braking the stencil sheet to be expanded while it is being wound around the circumference of the printing drum according to a rotation thereof with the leading end of the stencil sheet being held by the stencil sheet leading end mounting means of the printing drum, the friction condition for ensuring the pulling by clamping of the leading end of the stencil sheet of the stencil sheet leading end clamping means can be determined independently of the friction condition for braking the stencil sheet being wound around the circumference of the printing drum, so that the pulling transportation of the leading end of the stencil sheet from the outlet of the stencil sheet perforation means to the stencil sheet leading end mounting means of the printing drum is definitely ensured, while the stencil sheet can be applied with a desirable expansion when it is wound around the circumference of the printing drum so as not to damage even highly delicately formed perforation images of the stencil sheet.

Further, by the clamping of the leading end of the stencil sheet by the stencil sheet leading end clamping means being released when reached the vicinity of the stencil sheet leading end mounting means of the printing drum, while in turn the leading end of the stencil sheet is fed out forward by the separate stencil sheet feeding roller pair so as to be fed into the stencil sheet leading end mounting means of the printing drum, there occurs no such deformation of the leading end of the stencil sheet as by a running wind during the transportation thereof from the outlet of the stencil sheet perforation means to the vicinity of the stencil sheet leading end mounting means of the printing drum even when the speed of the transportation is increased. Further, by such an arrangement that the leading end of the stencil sheet is fed into the stencil sheet leading end mounting means of the printing drum by the stencil sheet leading end feeding roller pair in the vicinity thereof with a control of the stencil sheet leading end feeding roller pair for a very small distance of transportation independently of a control of transportation for a relatively large distance of transportation extended from the outlet of the stencil sheet perforation means to the stencil sheet leading end mounting means of the printing drum, the means for each of the two separate controls can be individually optimized with respect to the strength and the sensitivity of their constructions, so that the leading end of the stencil sheet is always mounted to the stencil sheet leading end mounting means of the printing drum in a predetermined correct mounting condition.

In more detail, the carriage may have a main frame, and an auxiliary frame pivotably supported by the main frame, the stencil sheet leading end clamping means having a lower clamping element and an upper clamping element, the stencil sheet feeding roller pair having a lower roller and an upper roller, the lower clamping element and the lower roller being mounted on the main frame, the upper clamping element and the upper roller being mounted on the auxiliary frame, the auxiliary frame being adapted to be pivoted relative to the main frame by an action of a cam follower engaging a cam when the carriage comes to the vicinity of the outlet of the stencil sheet perforation means so as to remove the upper clamping element and the upper roller from the lower damping element and the lower roller, respectively.

In such a construction, the auxiliary frame may be biased toward a regular position relative to the main frame by a spring.

The stencil printer of the above construction may further comprise a pair of guide rails extending between the vicinity of the outlet of the stencil sheet perforation means and the vicinity of the stencil sheet leading end mounting means of the printing drum stopped at the predetermined rotational position, the carriage being supported and guided by the guide rail pair at opposite side portions thereof.

In such a construction, the guide rails may have a branch portion adapted to be selectively branched in a way thereof, the carriage being capable of supplying the stencil sheet to at least two printing drums separately according to a non-branched state and a branched state.

Further, the guide rail pair may be deflected at an end portion thereof close to the stencil sheet perforation means so that the carriage coming to the vicinity of the outlet of the stencil sheet perforation means is inclined so as to bias an end of the main frame thereof close to the stencil sheet perforation means downward relative to the stencil sheet perforation means, so that thereby the lower clamping element and the lower roller are biased downward relative to the outlet of the stencil sheet perforation means, while the upper clamping element and the upper roller are biased upward relative to the outlet of the stencil sheet perforation means.

BRIEF DESCRIPTION OF THE DRAWINGS

In the accompanying drawings.

DESCRIPTION OF THE EMBODIMENT

In the following, the invention will be described in more detail with respect to an embodiment thereof by referring to the accompanying drawings.

Figure 1:
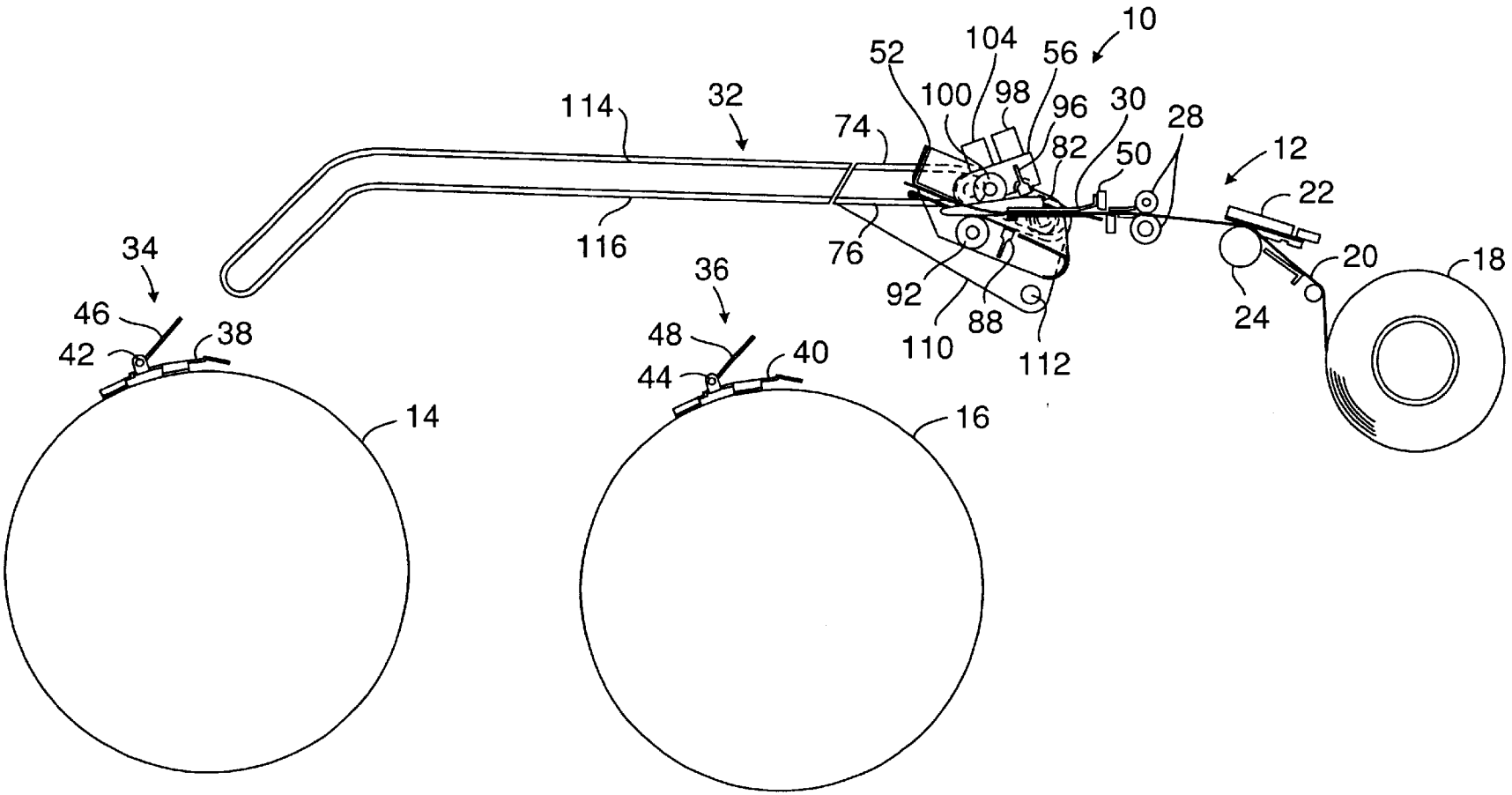
FIG. 1 is a diagrammatical side view showing the general construction of the essential portions of an embodiment of the stencil printer equipped with the stencil sheet leading end guiding carriage according to the present invention.

Referring to FIG. 1 diagrammatically showing a side view of only an essential portion of an embodiment of the present invention constructed as a two drum type stencil printer, 10 is a carriage for guiding a leading end of a stencil sheet. In FIG. 1, the carriage 10 is shown particularly in a condition where it has come to a vicinity of an outlet of stencil sheet perforation means 12. This stencil printer is of a two drum type having a first printing drum 14 and a second printing drum 16 as shown in the figure, wherein a stencil sheet 20 fed out from a roll 18 serving as a source thereof is conducted through the stencil sheet perforation means 12 including a thermal head 22, a platen roller 24, a pair of stencil sheet feed out rollers 28 and a stencil sheet feed out port 30, so that a perforated stencil sheet is mounted around the printing drum 14 or 16 to do a printing.

The stencil sheet fed out from the stencil sheet feed out port 30 is conducted by the carriage 10 running along a guide rail 32 supported by a support frame not shown in the figure toward stencil sheet leading end mounting means 34 of the printing drum 14 stopped at a predetermined rotational position for mounting the stencil sheet or to stencil sheet leading end mounting means 36 of the printing drum 16 stopped at a predetermined rotational position for mounting the stencil sheet. The stencil sheet leading end mounting means 34 and 36 have bar-like stencil sheet receiving bases 38 and 40 provided along a generatrix of each of the cylindrical shape of the printing drums, and clamps 46 and 48, respectively, the clamps 46 and 48 being pivotable about pivot shafts 42 and 44 betweened an open position removed from the stencil sheet receiving base 38 and 40 as shown in FIG. 1 and a closed position pressed onto the stencil sheet receiving bases 38 and 40, respectively. After the leading end of the stencil sheet conducted by the carriage 10 has been mounted to the printing drum 14 or 16 by the stencil sheet leading end mounting means 34 or 36, the printing drum 14 or 16 is rotated so that the stencil sheet of a one sheet length is mounted around the printing drum, and a trailing end of the one sheet length stencil sheet is cut by a cutter 50.

Figure 2:
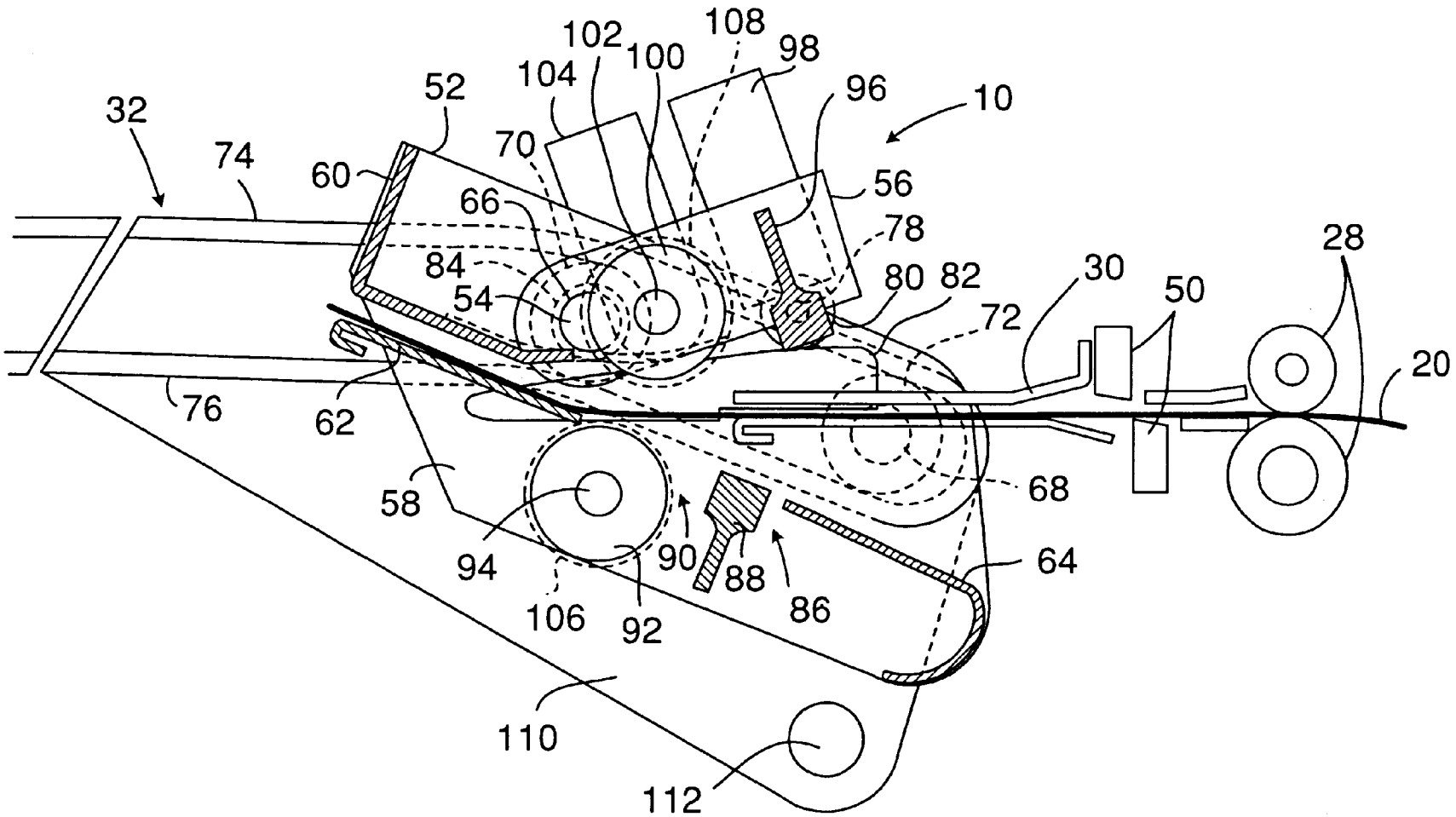
FIG. 2 is a side view showing in an enlargement further details of the carriage and constructions therearound in the state shown in FIG. 1.

FIG. 2 is a diagrammatical side view showing the structure of the carriage 10 and the guide rail therearound in an enlargement at the position shown in FIG. 1. The carriage 10 has a main frame 52 and an auxiliary frame 56 pivotably mounted to the main frame by a pivot shaft 54. The main frame 52 is made of a pair of side plates 58 constructing opposite side edges of the width thereof and lateral bar members 60, 62 and 64 fixing the pair of side plates 58 to one another. Each of these lateral bar members 60, 62 and 64 provides a guide surface at a part thereof for guiding the stencil sheet therealong. The main frame 52 is equipped with rollers 70 and 72 mounted by shafts 66 and 68 to the outside of the pair of side plates 58, respectively, the rollers 70 and 72 being engaged between a pair of parallel rail members 74 and 76 of the guide rail 32, so as to be movable therealong. In the shown embodiment, the shafts 66 for the pair of rollers 70 are formed integral with the pivot shaft 54 for pivotably mounting the auxiliary frame 56 to the main frame 52. In other words, opposite end portions of the pivot shaft 54 are formed as the shafts 66.

The guide rail 32 formed of the pair of rail members 74 and 76 is inclined downwardly at a portion thereof located in the vicinity of the outlet of the stencil sheet perforation means 12, i.e. the stencil sheet feed out port 30, as shown in the figure, so that, when the carriage 10 comes to this position, the rollers 72 closer to the stencil sheet perforation means 12 lower relative to the other rollers 70, thereby inclining the main frame 52 at this position downward in facing the stencil sheet perforation means 12. On the other hand, the auxiliary frame 56 has a pair of rollers 80 rotatably supported by shafts 78 at opposite sides thereof, so that when these rollers ride on corresponding cams 82 supported by the supporting frame not shown in the figure, the auxiliary frame 56 is pivoted around the pivot shaft 54 in the counter clockwise direction in the figure relative to the main frame 52. The pivotal movement of the auxiliary frame 56 about the pivot shaft 54 relative to the main frame 52 occurs against an elastic biasing force applied by a spring clip 84 provided around the pivot shaft 54 so as to elastically drive the auxiliary frame 56 in the clockwise direction in the figure around the pivot shaft 54 relative to the main frame 52. Thus, when the carriage 10 has come to the vicinity of the outlet of the stencil sheet perforation means 12, the main frame 52 is inclined so that the end thereof facing the stencil sheet perforation means 12 descends, while the auxiliary frame 56 is inclined so that the end thereof facing the stencil sheet perforation means 12 ascends, whereby the stencil sheet feed out port 30 of the stencil sheet perforation means 12 is deeply inserted into an open space formed between the main frame and the auxiliary frame.

The main frame 52 carries stationarily a lower clamping element 88 of stencil sheet leading end clamping means 86 as extending in the lateral direction of the carriage, and a lower roller 92 of a pair of stencil sheet leading end feeding rollers 90 as rotatably supported by a shaft 94 on the left side of the lower clamping element 88 as viewed in the figure in parallel thereto. On the other hand, the auxiliary frame 56 carries an upper clamping element 96 of the stencil sheet leading end clamping means 86 as extending in the lateral direction of the carriage and supported by a pair of actuators 98 at opposite ends thereof The auxiliary frame 56 also carries an upper roller 100 of the stencil sheet leading end feeding roller pair 90 as extending in the lateral direction of the carriage and supported by a pair of actuators 104 via an integrally rotatable shaft 102 at opposite ends thereof. The upper clamping element 96 is moved by an operation of the pair of actuators 98 supporting the opposite ends thereof between a position at which it is pressed against the opposing lower clamping element 88 and a position at which it is removed from the lower clamping element 88. The upper roller 100 is moved by the pair of actuators 104 supporting the opposite ends thereof between a position at which it is pressed against the lower roller 92 and a position removed from the lower roller 92. Further, the upper roller 100 is selectively driven in rotation by one or both of the actuators 104 via the shaft 102. The lower roller 92 is provided with a gear 106 at one end thereof, while the upper roller 100 is provided with a gear 108 at one end thereof. These gears 106 and 108 mesh with one another when the upper roller 100 is pressed against the lower roller 92 by the actuators 104, so that the lower roller 92 is driven in rotation in synchronization with the upper roller 100 in the direction opposite to that of the upper roller 100 when the upper roller is driven in rotation by one or both of the actuators 104.

A part of the guide rail 32 shown in FIG. 2 forming a part thereof positioned in the vicinity of the outlet of the stencil sheet perforation means 12 is supported by a switching plate 110 which in turn is pivotably supported by a pivot shaft 112 from the support frame not shown in the figure so to be pivotable around a central axis of the pivot shaft 112.

Figure 3:
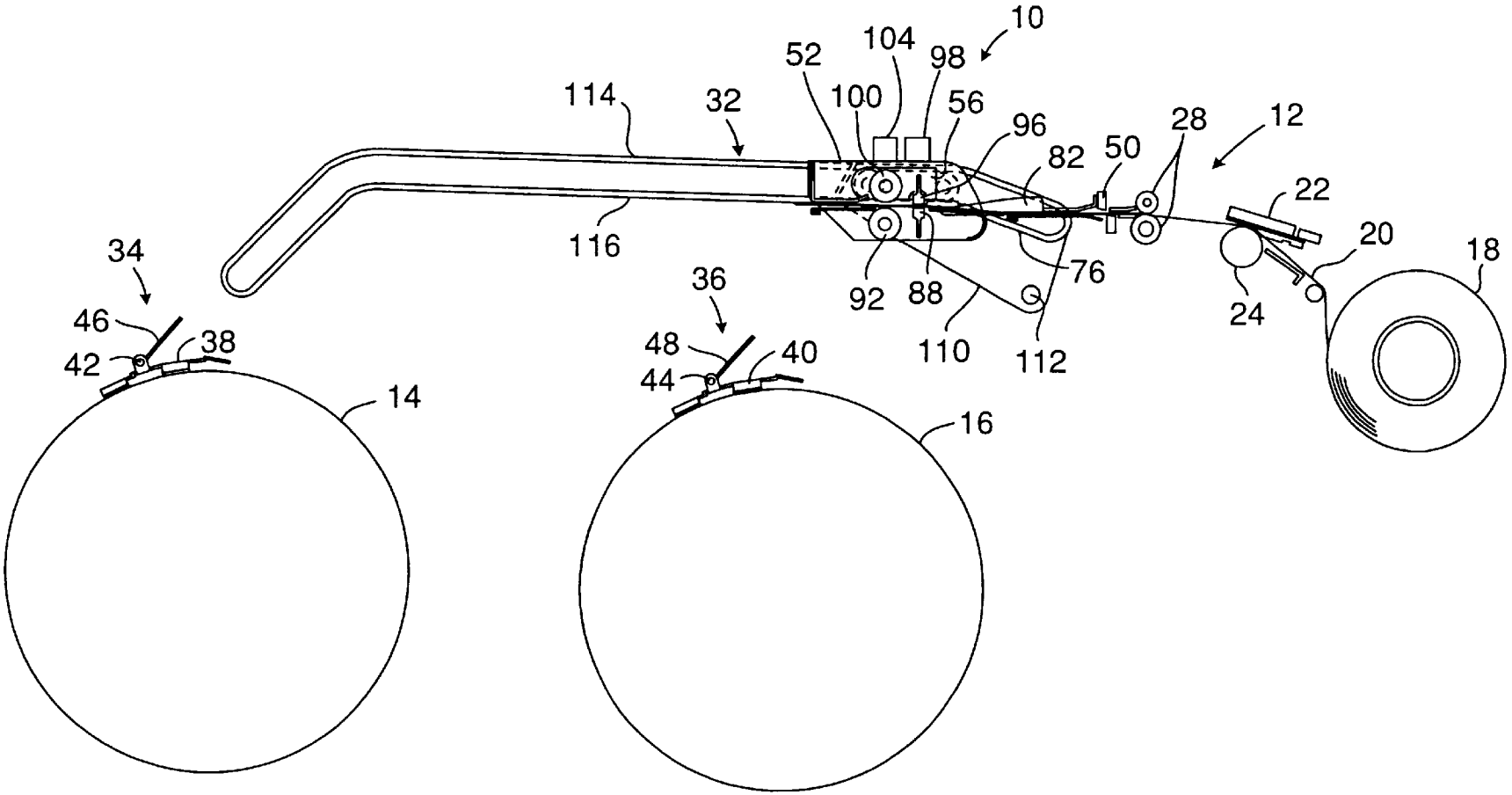
FIG. 3 is a diagrammatical side view similar to FIG. 1, showing the carriage in a state slightly moved from the state shown in FIG. 1.
Figure 4:
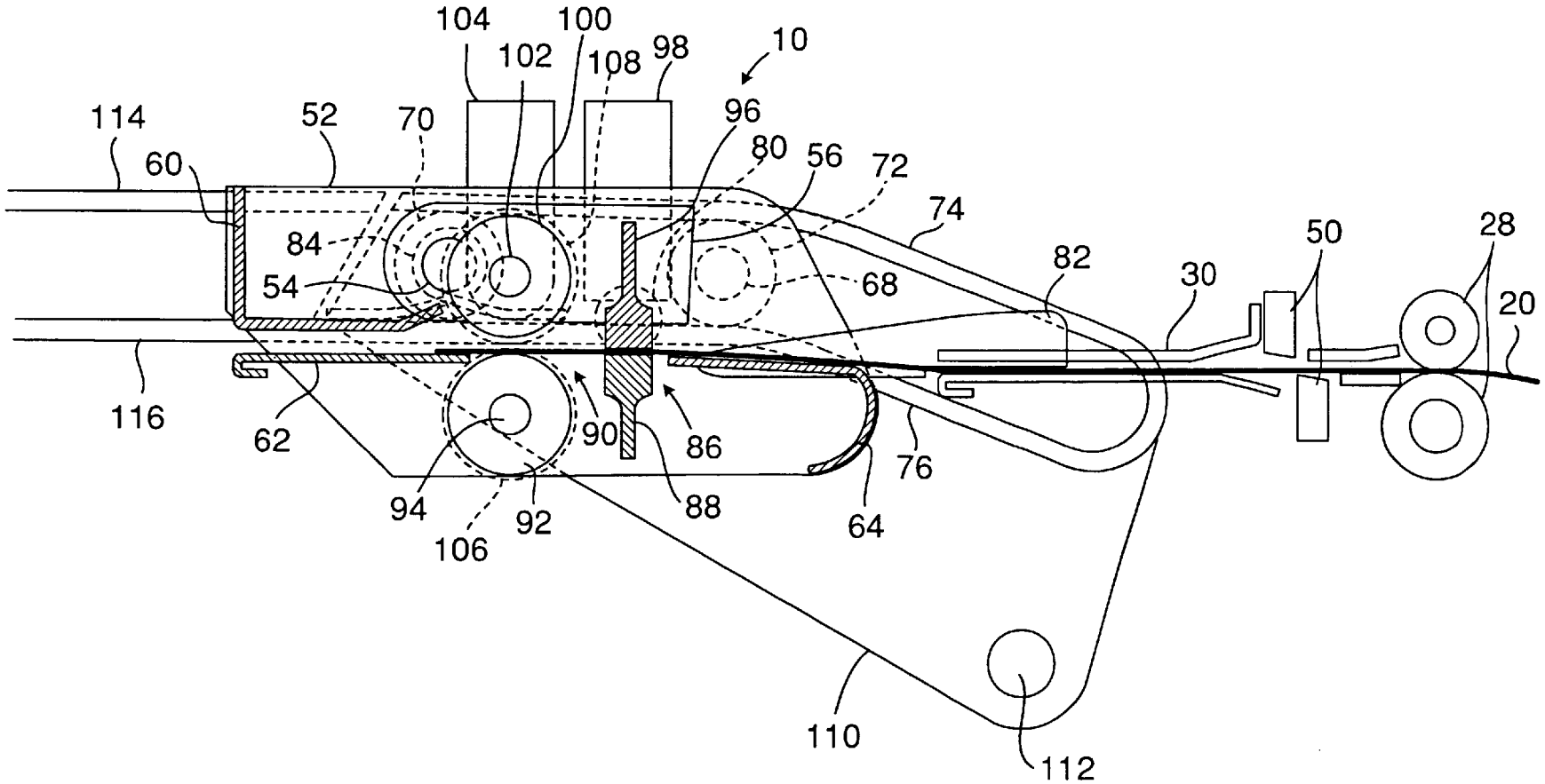
FIG. 4 is a side view showing in an enlargement further details of the carriage and constructions therearound shown in FIG. 3.

When the leading end of the perforated stencil sheet 20 was inserted into the carriage 10 positioned in the vicinity of the outlet of the stencil sheet perforation means 12 as shown in FIGS. 1 and 2, the carriage 10 is now moved by carriage self-driving means incorporated therein not shown in the figure or outside carriage drive means arranged along the guide rail 32 not shown in the figure to the position shown in FIGS. 3 and 4 at which the roller 72 comes out of the inclined end of the guide rail 32, while the rollers 80 of the auxiliary frame 56 sliding off of the inclined surfaces of the cams 82, thereby turning the auxiliary frame 56 correspondingly around the pivot shaft 54 in the clockwise direction in the figure relative to the main frame 52 by the action of the spring clip 84, so that the auxiliary frame 56 reaches its regular mounting position relative to the main frame 52. Here the actuators 98 are operated so that the upper clamping element 96 is moved toward the lower clamping element 88, thereby clamping the leading end of the stencil sheet 20 therebetween as shown in FIGS. 3 and 4. At this time, the leading edge of the stencil sheet may reach a position slightly exceeding the nip region between the lower roller 92 and the upper roller 100 of the stencil sheet leading end feeding roller pair 90. In this state, the upper roller 100 may still be held as removed from the lower roller 92 by the actuators 104.

Figure 5:
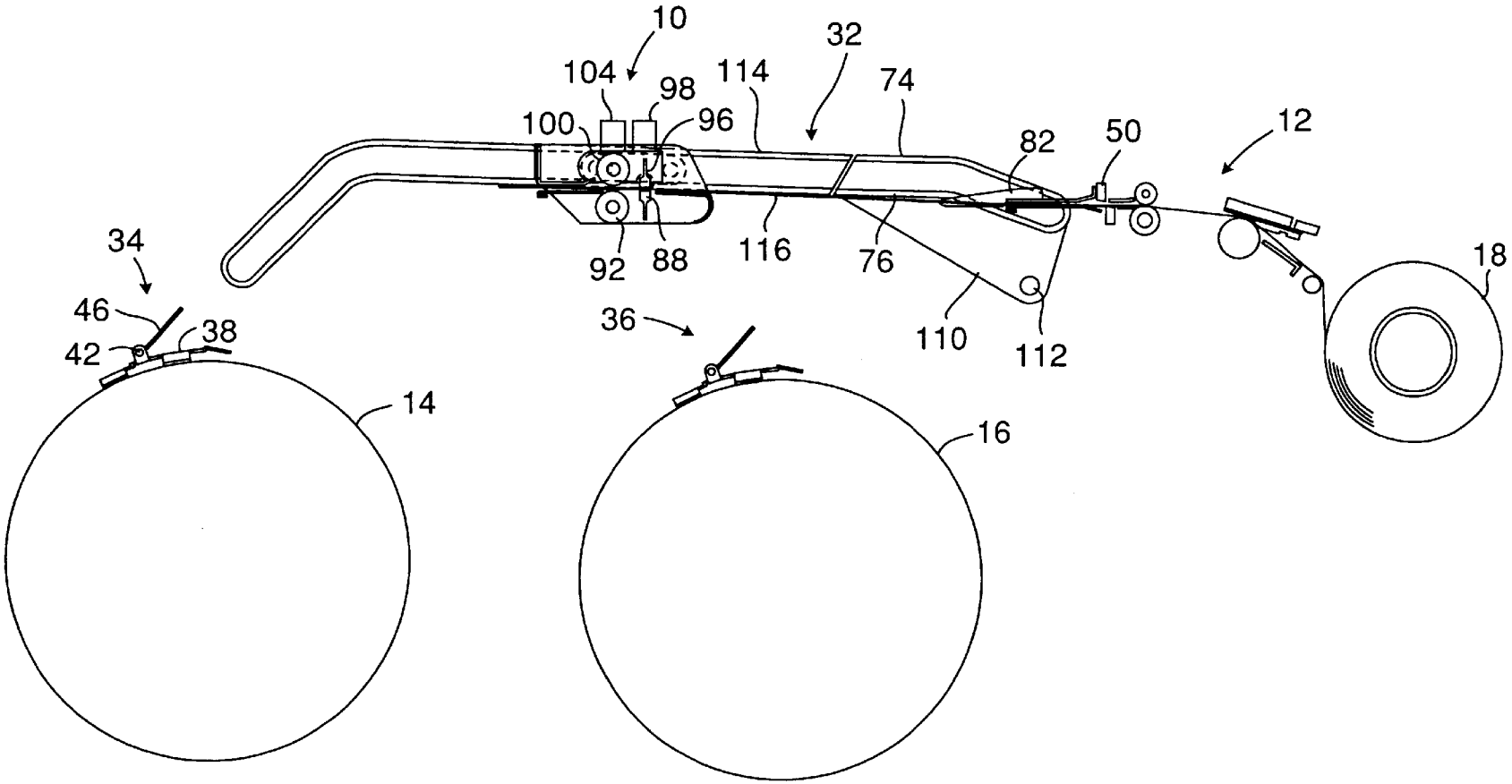
FIG. 5 is a diagrammatical side view similar to FIG. 1, showing the carriage in a state slightly moved leftward from the state shown in FIG. 3 along the guide rail.
Figure 6:
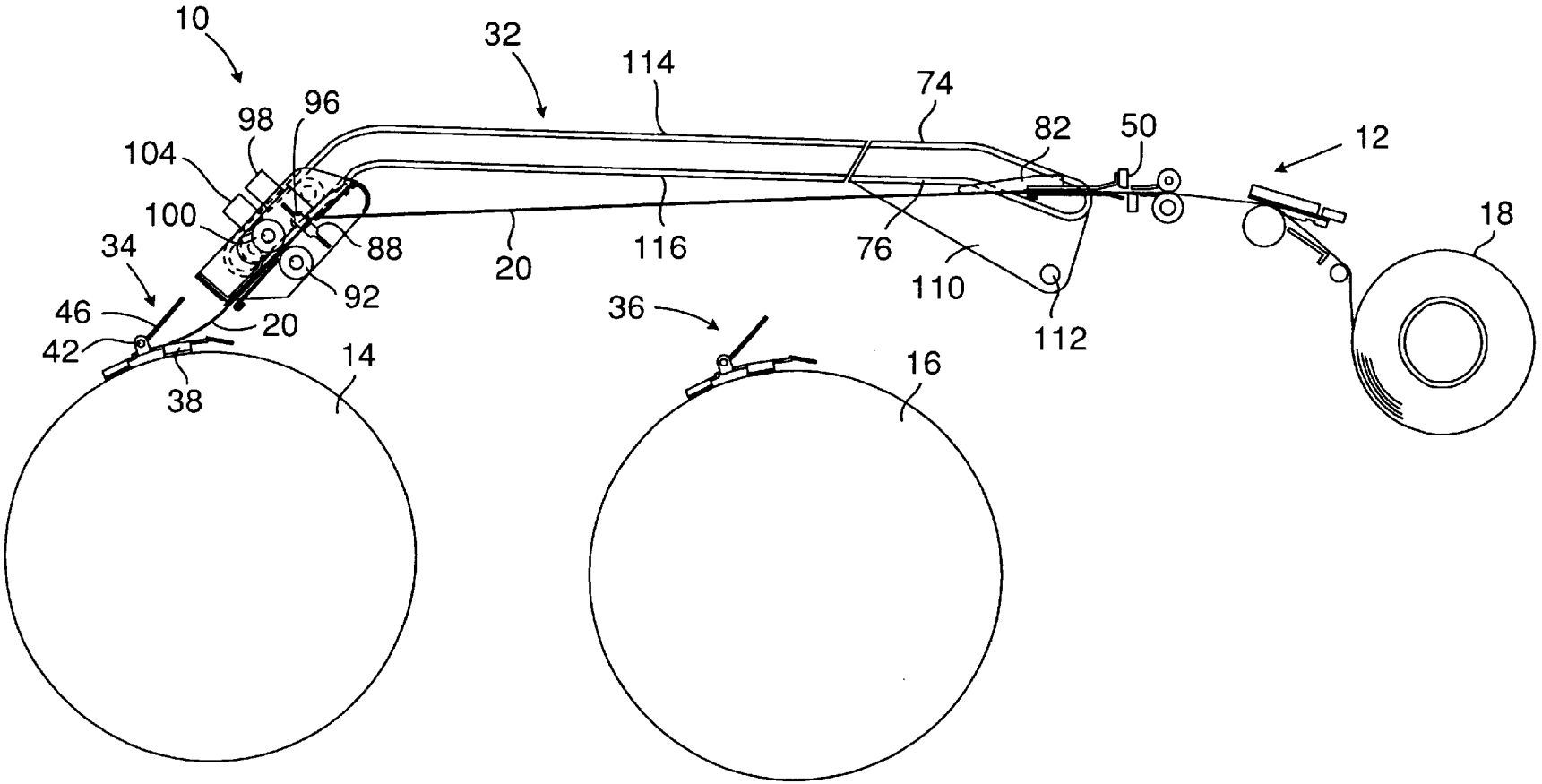
FIG. 6 is a diagrammatical side view similar to FIG. 1 and others, showing the carriage in the state operating in the vicinity of the stencil sheet leading end mounting means of the first printing drum.

When the stencil sheet is to be mounted onto the printing drum 14, the carriage 10 is moved from the portion of the guide rail 32 made of the rail members 74 and 76 supported by the switching plate 110 to a portion thereof made of rail members 114 and 116 as shown in FIG. 5, and to finally reach a position in the vicinity of the stencil sheet leading end mounting means 34 of the printing drum 14 stopped at a predetermined rotational position such as shown in FIG. 6. When the carriage 10 has reached this position, the actuators 98 of the stencil sheet leading end clamping means 86 are operated so as to remove the upper clamping element 96 from the lower clamping element 88, thereby releasing the clamping of the leading end of the stencil sheet by the stencil sheet leading end clamping means 86, while at the same time the actuators 104 of the stencil sheet leading end feeding roller pair 90 are operated so as to press the upper roller 100 to the lower roller 92 with the leading end of the stencil sheet being clamped therebetween. At this time, the gear 106 provided at one end of the lower roller 92 meshes with the gear 108 provided at one end of the upper roller 100. Then, one or both of the actuators 104 are operated to drive the upper roller 100 to rotate in the clockwise direction in the figure in a controlled manner, with the lower roller 92 being rotated in synchronization with the upper roller 100 in the counter clockwise direction in the figure, whereby the leading end of the stencil sheet clamped between the pair of rollers 92 and 100 is fed out from the carriage 10 so as to be fed into between the stencil sheet receiving base 38 and the opened clamp 46 of the stencil sheet leading end mounting means 34. A trailing end of the stencil sheet of a one sheet length is cut by the cutter 50 in the way or after the end of the pulling out of the stencil sheet by the carriage 10 according to the length of the guide rail 32.

When the leading end of the stencil sheet was introduced onto the stencil sheet receiving base 38 in a predetermined manner, the clamp 46 is closed over the stencil sheet receiving base 38, thus completing the mounting of the stencil sheet leading end on the printing drum 14. Then the printing drum 14 is rotated in the counter clockwise direction in the figure by a printing drum driving mechanism not shown in the figure for winding the stencil sheet therearound. During this process, one or both of the actuators 104 apply a braking of a predetermined strength to the upper roller 100 so that the stencil sheet wound around the printing drum 14 according to the rotation thereof is maintained at any optimum controlled condition of expansion which will never damage even highly delicate perforations formed in the stencil sheet.

Figure 7:
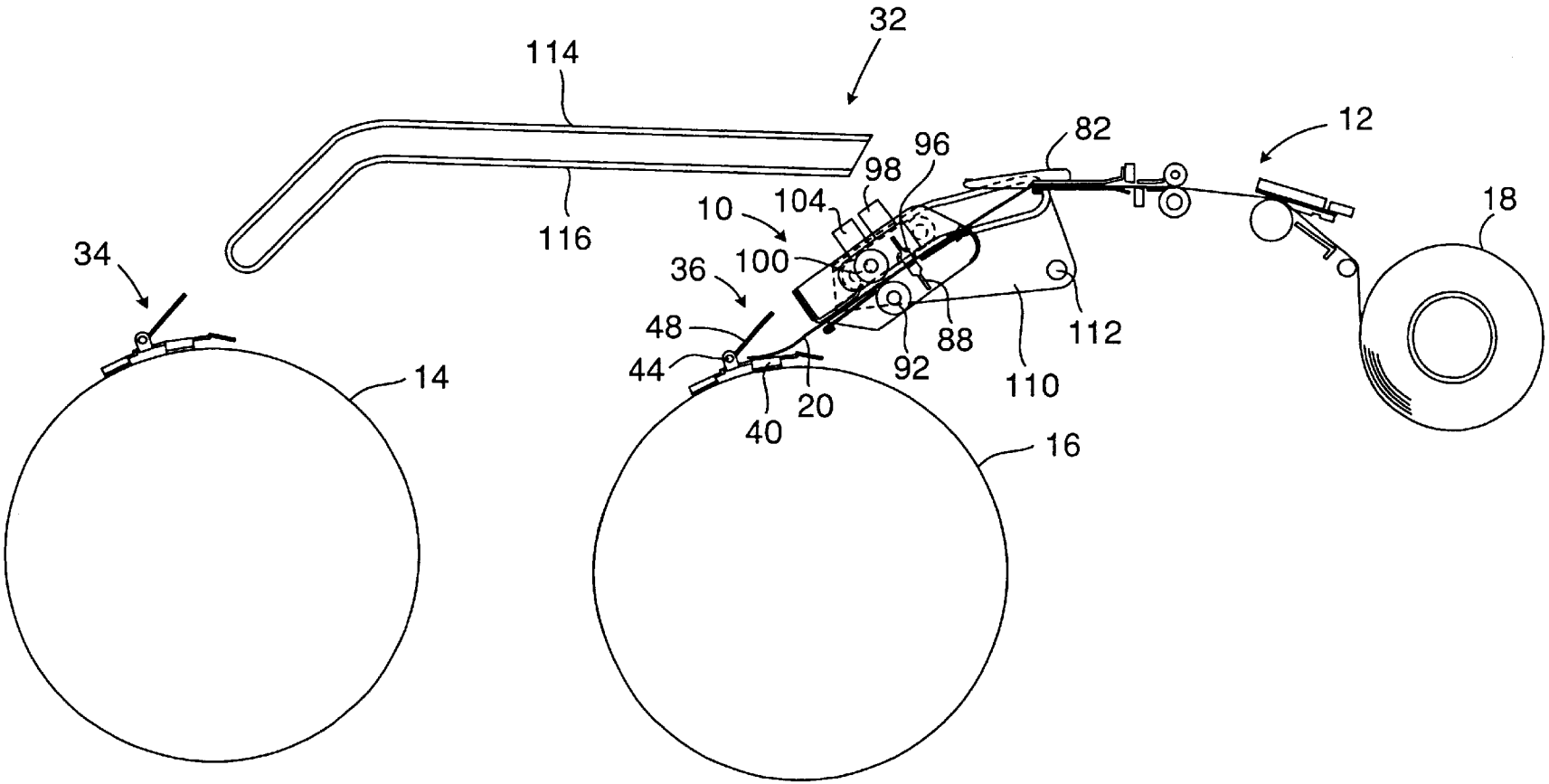
FIG. 7 is a diagrammatical side view similar to FIG. 1 and others, showing the carriage in the state operating in the vicinity of the stencil sheet leading end mounting means of the second printing drum.

In the case that the stencil sheet is to be mounted onto the printing drum 16, when the carriage 10 has moved from the position shown in FIG. 1 to the position shown in FIG. 3, the switching plate 110 is turned around the pivot shaft 112 as shown in FIG. 7 by a switching-over mechanism not shown in the figure. In the shown embodiment, without further moving the carriage 10, this is brought to a position in the vicinity of the stencil sheet leading end mounting means 36 of the printing drum 16. Here the stencil sheet leading end clamping means 86 and the stencil sheet leading end feeding roller pair 90 are operated by the actuators 98 and 104, respectively, so that the leading end of the stencil sheet is mounted to the stencil sheet leading end mounting means 36, and then the printing drum 16 is rotated so that the stencil sheet is wound around the printing drum 16 in an expanded condition, in the same manner as described with respect to the printing drum 14.

Although the present invention has been described in detail with respect to an embodiment thereof, it will be apparent for those skilled in the art that various modifications are possible with respect to the shown embodiment within the scope of the present invention.

What is claimed is:

1. A stencil printer comprising:

a printing drum having means provided along a generatrix of a cylindrical circumference thereof for mounting a leading end of a stencil sheet, the printing drum being adapted to be stopped at a predetermined rotational position for mounting the stencil sheet thereon;

means for perforating the stencil sheet; and a carriage guided to reciprocate between a vicinity of an outlet of the stencil sheet perforation means and a vicinity of the stencil sheet leading end mounting means of the printing drum stopped at the predetermined rotational position;

wherein the carriage has means for selectively clamping the leading end of the stencil sheet perforated by the stencil sheet perforation means, and a pair of rollers for feeding the stencil sheet when the stencil sheet leading end clamping means are not clamping the stencil sheet, the stencil sheet feeding roller pair being adapted to feed the stencil sheet which had been clamped at the leading end thereof by the stencil sheet leading end clamping means toward the stencil sheet leading end mounting means as starting from the leading end when the carriage is positioned in the vicinity of the stencil sheet leading end mounting means of the printing drum stopped at the predetermined rotational position and then to brake the stencil sheet while it is being wound around the circumference of the printing drum with the leading end thereof being held by the stencil sheet leading end mounting means.

2. A stencil printer according to claim 1, wherein the carriage has a main frame, and an auxiliary frame pivotably supported by the main frame, the stencil sheet leading end clamping means having a lower clamping element and an upper clamping element, the stencil sheet feeding roller pair having a lower roller and an upper roller, the lower clamping element and the lower roller being mounted on the main frame, the upper clamping element and the upper roller being mounted on the auxiliary frame, the auxiliary frame being adapted to be pivoted relative to the main frame by an action of a cam follower engaging a cam when the carriage comes to the vicinity of the outlet of the stencil sheet perforation means so as to remove the upper clamping element and the upper roller from the lower clamping element and the lower roller, respectively.

3. A stencil printer according to claim 2, wherein the auxiliary frame is biased toward a regular position relative to the main frame by a spring.

4. A stencil printer according to claim 1, further comprising a pair of guide rails extending between the vicinity of the outlet of the stencil sheet perforation means and the vicinity of the stencil sheet leading end mounting means of the printing drum stopped at the predetermined rotational position, the carriage being supported and guided by the guide rail pair at opposite side portions thereof.

5. A stencil printer according to claim 4, wherein the guide rails have a branch portion adapted to be selectively branched in a way thereof, the carriage being capable of supplying the stencil sheet to at least two printing drums separately according to a non-branched state and a branched state.

6. A stencil printer according to claim 1, wherein the carriage has a main frame, and an auxiliary frame pivotably supported by the main frame; the stencil sheet leading end clamping means having a lower clamping element and an upper clamping element; the stencil sheet feeding roller pair having a lower roller and an upper roller; the lower clamping element and the lower roller being mounted on the main frame; the upper clamping element and the upper roller being mounted on the auxiliary frame; the auxiliary frame being adapted to be pivoted relative to the main frame by an action of a cam follower engaging a cam when the carriage comes to the vicinity of the outlet of the stencil sheet perforation means so as to remove the upper clamping element and the upper roller from the lower clamping element and the lower roller, respectively, the auxiliary frame being biased toward a regular position relative to the main frame by a spring, the stencil printer further comprising a pair of guide rails extending between the vicinity of the outlet of the stencil sheet perforation means and the vicinity of the stencil sheet leading end mounting means of the printing drum stopped at the predetermined rotational position, the carriage being supported and guided by the guide rail pair at opposite side portions thereof, the guide rail pair being deflected at an end portion thereof close to the stencil sheet perforation means so that the carriage coming to the vicinity of the outlet of the stencil sheet perforation means is inclined so as to bias an end of the main frame thereof close to the stencil sheet perforation means downward relative to the stencil sheet perforation means, so that thereby the lower clamping element and the lower roller are biased downward relative to the outlet of the stencil sheet perforation means, while the upper clamping element and the upper roller are biased upward relative to the outlet of the stencil sheet perforation means.

* * * * *